US005382561A

United States Patent [19]

Mori et al.

[11] Patent Number: 5,382,561

[45] Date of Patent: Jan. 17, 1995

[54] SUBLIMATION TYPE COLOR PRINTING SHEET

[75] Inventors: Masukuni Mori; Osamu Sakurai, both of Bisai, Japan

[73] Assignee: Tsuyakin Co., Ltd., Aichi, Japan

[21] Appl. No.: 896,968

[22] Filed: Jun. 11, 1992

[30] Foreign Application Priority Data

Jun. 11, 1991 [JP] Japan ..... 3-165182
Oct. 9, 1991 [JP] Japan ..... 3-289520

[51] Int. Cl.[6] ..... B41M 5/035; B41M 5/38

[52] U.S. Cl. ..... 503/227; 428/195; 428/913; 428/914

[58] Field of Search ..... 8/471; 428/195, 913, 428/914; 503/227

[56] References Cited

U.S. PATENT DOCUMENTS 4,619,665 10/1986 Sideman et al. ..... 8/402
4,725,284 2/1988 Black et al. ..... 8/471
4,824,437 4/1989 Gregory ..... 8/471
4,880,768 11/1989 Mochizuki et al. ..... 503/227
4,923,846 5/1990 Kutsukake et al. ..... 503/227
4,933,315 6/1990 Kanto et al. ..... 503/227
4,952,553 8/1990 Kanto et al. ..... 503/227

*Primary Examiner*—B. Hamilton Hess
*Attorney, Agent, or Firm*—Wenderoth, Lind & Ponack

[57] ABSTRACT

A sublimation type color printing sheet is provided which can provide a color printing image having high light-proofing capability substantially equivalent or higher than that of a normal silver salt photograph. The sublimation type color thermal printing sheet includes a material sheet, on which a plurality of color inks at least including cyan, magenta, yellow, and additionally black if required are coated in a given order, wherein the ink of each color at least contains a dye included in anthraquinone type chromophore.

11 Claims, No Drawings

SUBLIMATION TYPE COLOR PRINTING SHEET

BACKGROUND OF THE INVENTION

1. Field of the Invention

The present invention relates generally to a sublimation type color printing sheet for a thermal transfer recording apparatus. More specifically, the invention relates to a sublimation type color printing sheet which can print an image having high light-proofing capability.

2. Description of the Prior Art

The thermal transfer recording apparatus has a heat unit, such as a thermal head for charging a heat on a thermal printing sheet. By varying the thermal load provided by the heat unit, an image having gradation can be transferred on an image recording medium, such as a paper.

Conventionally, there has been known a color thermal printing sheet for this type of application, which is prepared by selecting three specific primary color dyes among sublimation type dyes.

In the prior art, as these three primary color dyes, those of a high density type azo type chromophore group which has a large molecular extinction coefficient and high sensitivity, have been principally selected. However, such azo type chromophore can sensitively cause cleave decomposition of unsaturated double coupling in —N=N— by singlet oxygen or reduction gas due to irradiation of ultraviolet ray to degrade the original function of the azo type chromophore to cause variation or fading of color. Therefore, such conventional thermal color printing sheets are not at all satisfactory from the viewpoint of light-proofing capability.

DESCRIPTION OF THE INVENTION

Therefore, it is an object of the present invention is to provide a sublimation type color printing sheet which can provide a color printing image having high light-proofing capability substantially equivalent or higher than a silver salt photograph.

Another object of the invention is to provide a sublimation type color printing sheet which can transfer a color image which can assure to hold 7 to 8th grades in tests of JIS L 0841 (durability against sun beam), JIS L 0842 (durability against carbon arc light) and JIS L 0843 (durability against xenon arc light).

A further object of the present invention is to provide a sublimation type color printing sheet which can provide a high density ink coating surface with dyes having high light-proofing capability for assuring printing of a high density and high resolution printing image.

In order to accomplish the above-mentioned and other objects, the present invention provides a sublimation type color printing sheet which employs four colors of inks, i.e. cyan, magenta, yellow and black, or at least three colors of inks, i.e. cyan, magenta, and yellow, coated on the sheet. The basic molecular core of a sublimation type dye forming the cyan ink layer is of anthraquinone type. Also, the basic molecular core of a sublimation type dye forming the magenta ink layer is of anthraquinone type. The basic molecular core of a sublimation type dye forming the yellow ink layer is among anthraquinone type, quinophthalone type, acrido type, nitro type, pyridone type and pyrazolone type. The dye forming the black layer is a combination of the three primary colors, i.e. cyan, magenta and yellow, and a mixture of the above-mentioned three primary colors and orange, violet, green or so forth.

In the anthraquinone type chromophore coloring matter core, the electron density within the molecule is quite stable so as not to be easily decomposed by singlet oxygen or reduction gas due to irradiation of ultraviolet ray. Therefore, it has higher light-proofing capability than that of other groups of chromophores. On the other hand, due to a symmetric molecular core, the anthraquinone type chromophore coloring matters have a relatively small molecular extinction coefficient and are difficult to solve with general purpose solvents. Therefore, it is not possible to provide sufficient density with a singular composition. Therefore, it is required to set a recipe for combination of two or more dye materials. Accordingly, it is preferable to select dyes for three colors among those set forth above, taking the anthraquinone type as primary material.

Observing the anthraquinone type chromophores from the viewpoint of color wavelength, the primary tones of this chromophores are orange~red~violet~blue. Therefore, the yellow component is preferably composed with taking quinophthalone type chromophore as base dye and properly adding dye or dyes of anthraquinone type, and dye or dyes of acrido type, nitro type, pyridone type, and/or pyrazolone type.

Furthermore, With respect to the black component, by mixing the cyan and magenta components which are composed with taking anthraquinone type dyes as primary dyes and the yellow component which is composed by adding anthraquinone type chromophore to quinophthalone type chromophore as base dye, or, in the alternative, by further adding orange, violet, green, and so forth, specifically orange for yellow ink layer, violet for magenta ink layer, green for cyan ink layer and so forth, it becomes possible that the three primary colors and black can be composed with taking the anthraquinone chromophore as primary composition.

(1) The anthraquinone type chromophore coloring matter core to be used in the present invention is generally expressed in the formula 1:

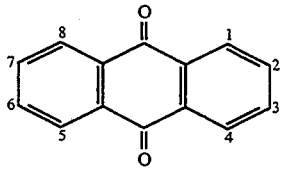

1

(1) In the formula 1, among carbon positions 1 to 8, at the positions of 1, 4, 5 and 8, at least one or more of —$NH_2$ group or NHR group (where R represents lower alkyl group, cycloalkyl group, alkenyl group, aryl group, aralkyl group, alkoxyalkyl group, which is in a direct chain or can be branched), or —OH group are coordinated, or, in the alternative, two or more groups among three groups of —$NH_2$, —NHR or —OH are coordinated.

(2) Also, at positions 2, 3, 6 and 7, at least binder groups expressed in the formulae 2 through 7, are not present, or one or more are coordinated at any one of positions 2, 3, 6 and 7, or, in the further alternative, two or more of the binder groups expressed in the formulae 2 to 7 are coordinated.

Coupling groups at positions 2, 3, 6, 7 of anthraquinone type chromophore coloring matter core carbon, where group X has the same meaning as group R:

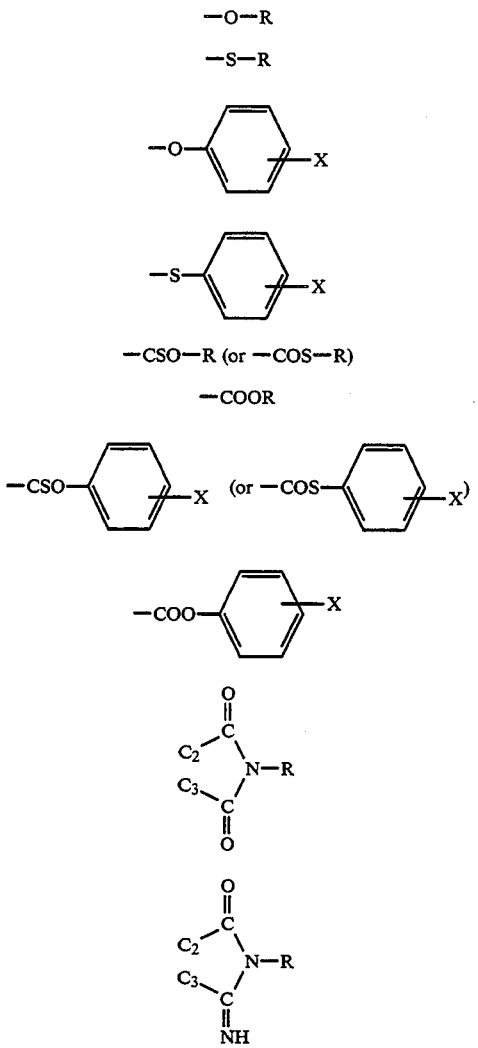

The anthraquinone type chromophore group compounds satisfying relevant conditions in the foregoing sections (1) and (2) are used. Practically, examples of the anthraquinone type chromophore group (red~blue, violet~green), as identified by C.I. solvent No. and C.I. disperse No. are listed below, but are not exhaustive:

C.I. solvent red 52, C.I. solvent red 60, C.I. solvent red 111, C.I. solvent red 138. C.I. solvent red 143, C.I. solvent red 146, C.I. solvent red 149, C.I. solvent red 150, C.I. solvent red 151, C.I. solvent red 152, C.I. solvent red 155, C.I. solvent red 168, C.I. solvent red 169, C.I. solvent red 177, C.I. solvent red 207, C.I. solvent red 230, C.I. disperse red 1, C.I. disperse red 4, C.I. disperse red 11, C.I. disperse red 15, C.I. disperse red 22, C.I. disperse red 52, C.I. disperse red 53, C.I. disperse red 55, C.I. disperse red 60, C.I. disperse red 86, C.I. disperse red 91, C.I. disperse red 92, C.I. disperse red 127, C.I. disperse red 132, C.I. disperse red 146, C.I. disperse red 159, C.I. disperse red 189, C.I. disperse red 191, C.I. disperse red 207, C.I. disperse red 229, C.I. disperse red 239, C.I. disperse red 283, C.I. disperse red 302, C.I. disperse red 362, C.I. disperse red 364, C.I. solvent blue 12, C.I. solvent blue 21, C.I. solvent blue 35, C.I. solvent blue 36, C.I. solvent blue 45, C.I. solvent blue 59, C.I. solvent blue 63, C.I. solvent blue 78, C.I. solvent blue 83, C.I. solvent blue 94, C.I. solvent blue 95, C.I. solvent blue 97, C.I. solvent blue 105, C.I. solvent blue 112, C.I. solvent blue 122, C.I. disperse blue 1, C.I. disperse blue 3, C.I. disperse blue 5, C.I. disperse blue 6, C.I. disperse blue 7, C.I. disperse blue 14, C.I. disperse blue 19, C.I. disperse blue 22, C.I. disperse blue 23, C.I. disperse blue 24, C.I. disperse blue 26, C.I. disperse blue 27, C.I. disperse blue 34, C.I. disperse blue 35, C.I. disperse blue 55, C.I. disperse blue 56, C.I. disperse blue 60, C.I. disperse blue 72, C.I. disperse blue 73, C.I. disperse blue 73:1, C.I. disperse blue 77, C.I. disperse blue 81, C.I. disperse blue 87, C.I. disperse blue 87:1, C.I. disperse blue 91, C.I. disperse blue 99, C.I. disperse blue 149, C.I. disperse blue 154, C.I. disperse blue 158, C.I. disperse blue 165, C.I. disperse blue 185, C.I. disperse blue 197, C.I. disperse blue 198, C.I. disperse blue 214, C.I. disperse blue 288, C.I. disperse blue 331, C.I. disperse blue 361, C.I. disperse blue 366, C.I. solvent violet 11, C.I. solvent violet 13, C.I. solvent violet 14, C.I. solvent violet 31, C.I. solvent violet 32, C.I. solvent violet 33, C.I. solvent violet 34, C.I. solvent violet 36, C.I. solvent violet 45, C.I. disperse violet 1, C.I. disperse violet 4, C.I. disperse violet 6, C.I. disperse violet 8, C.I. disperse violet 17, C.I. disperse violet 26, C.I. disperse violet 27, C.I. disperse violet 28, C.I. disperse violet 31, C.I. disperse violet 35, C.I. disperse violet 38, C.I. disperse violet 46, C.I. disperse violet 56, C.I. solvent green 3, C.I. solvent green 26, C.I. disperse green 6:1 and so forth.

Examples of the anthraquinone type coloring matter group preferred to be used for the yellow component, which are not exhaustive, are C.I. solvent yellow 163, C.I. vat yellow 3, C.I. disperse orange 11, C.I. disperse orange 119, C.I. solvent orange 60, C.I. solvent orange 64, C.I. solvent orange 68, C.I. solvent orange 71, C.I. solvent orange 86 and so forth. It should be noted that the number of anthraquinone type coloring matter group for the yellow component is relatively small. Therefore, it becomes necessary to use in combination therewith replacement which is chromophore basic core group having high light-proofing capability and, stable intermolecular electron density. In practice, as useful quinophthalone type coloring matter group, the following can be listed, but exhaustive: C.I. solvent yellow 33, C.I. solvent yellow 114, C.I. solvent yellow 128, C.I. solvent yellow 129, C.I. solvent yellow 157, C.I. disperse yellow 49, C.I. disperse yellow 54, C.I. disperse yellow 64, C.I. disperse yellow 149, C.I. disperse yellow 160, C.I. disperse yellow 224 and so forth. Also, as useful acrido type coloring matter group, the following can be listed, but exhaustive: C.I. disperse yellow 122 and so forth, as useful nitro type coloring matter group, the following can be listed, but exhaustive, C.I. disperse yellow 1, C.I. disperse yellow 9, C.I. disperse yellow 33, C.I. disperse yellow 42 and so forth, as suitable pyridone type coloring matter group, the following can be listed but not exhaustive, C.I. disperse yellow 231, and as suitable pyrazolone type coloring matter group, the following can be listed, but not exhaustive, C.I. solvent yellow 93 and so forth.

By forming the sublimation type color printing sheet with the color materials for cyan, magenta and yellow from the materials set forth above, the printed image can exhibit high light-proofing durability with the high light-proofing capability of the anthraquinone type chromophore at a level equivalent to or higher than that of silver salt photograph.

The inks to be used for forming the ink layers according to the present invention are prepared by solving with a solvent together with a binder. Preferably, the ink is prepared to contain 3~5 wt parts of dyes, 1~20 wt parts of binder, 96~70 wt parts of solvent in relation to 100 wt parts of total ink amount.

As the solvent, in order to solve the dyes at high concentration to form deep and high resolution image, chlorinated hydrocarbons, such as methylene dichloride, chloroform, chlorobenzene, aromatic hydrocarbons, such as toluene, xylene or so forth, ketones, such as methyl ethyl ketone, cyclohexanone or so forth, are preferred.

For the binder, it is required to stably maintain the color thermal printing sheets and an image formed by thermal printing, not to degrade light-proofing durability of the ink layer and the formed image, to have good compatibility with the dyes, to be soluble with solvent illustrated above, to be transparent after solidification by evaporation of the solvent, not to melt on a printing medium during thermal printing, not to form faded areas in the color thermal printing sheet and the printed image, and to have good adhering ability to the sheet. In view of such requirements, the preferred binder is selected among polyvinyl acetal resin having glass transition temperature in a range of 85° to 120° C., saturated polyester resin or a mixture of saturated polyester resin and polycarbonate resin, or polysulfone resin.

The above-mentioned polyvinyl acetal resin is available from the market, such as BY-111, 6000-C and 3000-K (from Denki Kagaku Kogyo K.K.) Polyvinyl acetal resin has suitable viscosity and high coating ability, in comparison with other binders. When polyvinyl acetal resin is used as the binder, it is preferred to preliminarily provide an anchor coat with polyester resin, polyurethane resin or polyamide resin for the surface to be coated, since polyvinyl acetal resin does not chemically hold the dyes. As saturated polyester resin, a resin formed by polycondensation of dicarboxylic acid component and diol component can be used.

On a surface of a material sheet, which does not mate with a thermal head of a thermal printing apparatus, the inks of yellow, magenta, cyan, and additionally black if required, are coated in order and then dried to form the ink layer. As applicable material sheet, plastic files of 0.2–25 μm thick, made of polyester, polyamide, polysulfone, polystyrene, vinyl chloride, polycarbonate or so forth can be listed. On the surface of the film mating with the thermal head, silicon resin, fluorine type resin, fluorine type lubricant or surfactant is coated to form a heat resisting layer or lubricating layer for preventing the sheet from sticking on the thermal head.

The printing medium to be printed a color image with the sublimation type color thermal printing sheet according to the present invention is not specified. For example, wood free paper, synthetic paper, fabrics, films, sheets or so forth can be used as the printing medium. It is preferred to form a printing receptacle layer by coating adhesive type resin and hardener therefor or cross-linking agent therefor, solvent, silicon type white fine powder, and surfactant having compatibility with the fine powder.

According to the present invention as set forth above, dyes for three primary colors are primarily selected in the anthraquinone type chromophore. The yellow component is composed with taking quinophthalone type chromophore as basic material, and adding anthraquinone type chromophore dye and, if applicable, dye of acrido type, nitro type, pyridone type or pyrazolone type chromophore. Also, the black component is composed with cyan and magenta component taking anthraquinone chromophore dye as primary composition and yellow component composed by taking quinophthalone type chromophore as primary composition and by adding the anthraquinone type chromophore, and if desired by further adding orange, violet, green and so forth. Therefore, all of the three primary colors and black components can be composed by containing anthraquinone type chromophore as primary composition.

By forming sublimation type color thermal printing sheet as set forth above, the printed image may have high light-proofing capability equivalent or higher than that of normal silver salt photograph with the high light-proofing property of anthraquinone type chromophore.

Here, as is well known, when high density coating is performed at unstably dispersed condition, in which the dye is contained in an amount beyond solubility of the solvent, the ink coated surface can be dulled due to dye molecular association. On the other hand, in general, the high light-proofing dye groups as set forth above, have small solubility to various solvents and have small molar absorbance at absorbing maximum wavelength (λmax). Therefore, the ink coating density with singular dye can be too low to use practically.

As a solution for the above-mentioned problem in the application of the present invention as set forth above, it is further proposed to use two or more dye groups in such a manner that each of the dyes are contained in an amount within a solubility of the solvent to obtain the desired high density ink coating surface.

Therefore, according to another aspect of the invention, there is provided a sublimation type color thermal printing sheet which is coated with at least three primary colors of cyan, magenta, yellow and, in addition, black, in which sublimation type dyes forming each of cyan, magenta, yellow and black ink layers are high light-proofing dyes, and each ink is prepared by blending two or more high light-proofing dyes in a pure solvent or mixture of two or more solvents.

As set forth above, when high light-proofing dyes, such as anthraquinone type chromophore groups, are used, difficulty is encountered in obtaining sufficient printing image density, due to low solubility to various solvents, small absorbance at maximum absorption wavelength (λmax) originated from molecular structure, and small transferring efficiency. The present invention as proposed above, solves this difficulty by blending two or more high light-proofing dyes within the solubility of each dye so that the total dye amount may be sufficient for obtaining satisfactory coating density (OD value is greater than or equal to 2.0 in Macbeth RD-914 densitometer).

As set forth, according to the present invention, two or more dyes are blended in pure solvent or a mixture of two or more solvents so that the amount of each dye will not exceed the solubility of the solvent and the total amount of dyes is sufficient for obtaining the desired density of the printed color image.

Needless to say, from the viewpoint of purely for high density image, it is desirable to solve two or more dyes in respectively suitable solvents independently and coat two or more inks thus prepared in overlapping manner. However, such process is too cumbersome for practical implementation. In contrast, according to the present invention, by solving two or more different dyes in a common solvent, either in a form of pure solvent or a mixture of two or more solvents, satisfactorily high density can be obtained without requiring cumbersome processes.

EXAMPLES

The examples of the present invention will be discussed herebelow. It should be noted that in the following discussion, the unit "part" represents "part by weight".

Example 1

By coating polyester resin on one side of polyester film of 4.5 μm thickness, an anchor coat in a thickness of 0.4 μm was formed.

Next, respective yellow, magenta, cyan and black inks are prepared independently with the following contents. These inks were coated in overall width of the film in a length of approximately 32 cm in order of yellow, magenta, cyan and black. Thus, a color thermal printing sheet was obtained. Here, a helio gravure printing press having a plate cylinder of 175 mesh was used as a coater.

| | |
|---|---|
| **Yellow Ink** | |
| dyes | |
| C.I. solvent yellow 163 (anthraquinone type) | 15 parts |
| C.I. disperse orange 119 (anthraquinone type) | 5 parts |
| C.I. disperse yellow 160 (quinophthalone type) | 10 parts |
| C.I. disperse yellow 224 (quinophthalone type) | 10 parts |
| binder | |
| polyvinyl acetal: resin BY-111 (Denki Kagaku Kogyo K.K.) | 30 parts |
| bridging agent | |
| polyisocyanate: resin Takenate D110N (Takeda Yakuhin Kogyo K.K.) | 10 parts |
| surface active type lubricant | |
| phlorocarbon type surfactant: Defenser MCF323 (Dainippon Ink Kagaku K.K.) | 5 parts |
| solvent | |
| toluene/MEK (1:1) | 915 parts |
| **Magenta Ink** | |
| dyes | |
| C.I. solvent red 168 | 20 parts |
| C.I. disperse red 22 | 10 parts |
| C.I. disperse red 53 | 10 parts |
| C.I. solvent violet 36 | 10 parts |
| binder | |
| polyvinyl acetal: resin 6000-C (Denki Kagaku Kogyo K.K.) | 30 parts |
| bridging agent | |
| polyisocyanate: resin Takenate D110N (Takeda Yakuhin Kogyo K.K.) | 10 parts |
| surface active type lubricant | |
| phlorocarbon type surfactant: Defenser MCF323 (Dainippon Ink Kagaku K.K.) | 5 parts |
| solvent | |
| toluene/MEK (1:1) | 905 parts |
| **Cyan Ink** | |
| dyes | |
| C.I. disperse blue 60 | 10 parts |
| C.I. disperse blue 87 | 10 parts |
| C.I. disperse blue 198 | 10 parts |
| C.I. disperse blue 7 | 10 parts |
| C.I. solvent green 3 | 10 parts |
| binder | |
| polyvinyl acetal: resin 6000-C (Denki Kagaku Kogyo K.K.) | 30 parts |
| bridging agent | |
| polyisocyanate: resin Takenate D110N (Takeda Yakuhin Kogyo K.K.) | 10 parts |
| surface active type lubricant | |
| phlorocarbon type surfactant: Defenser MCF323 (Dainippon Ink Kagaku K.K.) | 5 parts |
| solvent | |
| dichloromethane | 905 parts |
| **Black Ink** | |
| dyes | |
| C.I. disperse yellow 231 (pyridone type) | 30 parts |
| C.I. solvent red 168 | 20 parts |
| C.I. disperse violet 31 | 20 parts |
| C.I. solvent blue 35 | 25 parts |
| C.I. solvent blue 36 | 25 parts |
| binder | |
| polyvinyl acetal: resin 6000-C (Denki Kagaku Kogyo K.K.) | 30 parts |
| bridging agent | |
| polyisocyanate: resin Takenate D110N (Takeda Yakuhin Kogyo K.K.) | 10 parts |
| surface active type lubricant | |
| phlorocarbon type surfactant: Defenser MCF323 (Dainippon Ink Kagaku K.K.) | 5 parts |
| solvent | |
| dichloromethane | 835 parts |

Example 2

Similarly to the foregoing example 1, the following yellow, magenta, cyan and black inks are prepared. These inks are coated on one side of polyester film in thickness of 6.0 μm, in overall width of the film and in the length of 17 cm, in order of yellow, magenta, cyan and black. Thus, the color thermal printing sheet was obtained. As a coater, a multi-color gravure printing press was used.

| | |
|---|---|
| **Yellow Ink** | |
| dyes | |
| C.I. solvent yellow 163 (anthraquinone type) | 10 parts |
| C.I. disperse yellow 42 (nitro type) | 10 parts |
| C.I. disperse yellow 54 (quinophthalone type) | 10 parts |
| C.I. disperse yellow 122 (acrido type) | 10 parts |
| C.I. disperse yellow 149 (quinophthalone type) | 10 parts |
| binder | |
| polyvinyl acetal: resin BY-111 (Denki Kagaku Kogyo K.K.) | 30 parts |
| bridging agent | |
| polyisocyanate: resin Takenate D110N (Takeda Yakuhin Kogyo K.K.) | 10 parts |
| surface active type lubricant | |
| phlorocarbon type surfactant: Defenser MCF323 (Dainippon Ink Kagaku K.K.) | 5 parts |
| solvent | |
| toluene/MEK (1:1) | 905 parts |
| **Magenta Ink** | |
| dyes | |
| C.I. disperse red 146 | 10 parts |
| C.I. disperse red 91 | 10 parts |
| C.I. disperse red 132 | 10 parts |
| C.I. disperse red 207 | 10 parts |
| C.I. solvent red 155 | 10 parts |
| C.I. solvent violet 31 | 10 parts |
| C.I. disperse violet 31 | 15 parts |
| binder | |
| polyvinyl acetal: resin 6000-C (Denki Kagaku Kogyo K.K.) | 30 parts |
| bridging agent | |
| polyisocyanate: resin Takenate D110N (Takeda Yakuhin Kogyo K.K.) | 10 parts |
| surface active type lubricant | |
| phlorocarbon type surfactant: Defenser MCF323 (Dainippon Ink Kagaku K.K.) | 5 parts |
| solvent | |

-continued

| | |
|---|---|
| toluene/MEK (1:1) | 880 parts |
| Cyan Ink | |
| dyes | |
| C.I. disperse blue 198 | 10 parts |
| C.I. disperse blue 87 | 15 parts |
| C.I. disperse blue 185 | 10 parts |
| C.I. disperse blue 60 | 15 parts |
| C.I. solvent green 3 | 15 parts |
| C.I. solvent green 26 | 15 parts |
| C.I. disperse green 6:1 | 10 parts |
| binder | |
| polyvinyl acetal: resin 6000-C (Denki Kagaku Kogyo K.K.) | 30 parts |
| bridging agent | |
| Polyisocyanate: resin Takenate D110N (Takeda Yakuhin Kogyo K.K.) | 10 parts |
| surface active type lubricant | |
| phlorocarbon type surfactant: Defenser MCF323 (Dainippon Ink Kagaku K.K.) | 5 parts |
| solvent | |
| dichloromethane/chloroform (8:2) | 865 parts |
| Black Ink | |
| dyes | |
| C.I. disperse yellow 163 (anthraquinone type) | 30 parts |
| C.I. solvent red 60 | 20 parts |
| C.I. disperse violet 26 | 20 parts |
| C.I. solvent blue 63 | 25 parts |
| C.I. solvent blue 331 | 25 parts |
| binder | |
| Polyvinyl acetal: resin 6000-C (Denki Kagaku Kogyo K.K.) | 30 parts |
| bridging agent | |
| polyisocyanate: resin Takenate D110N (Takeda Yakuhin Kogyo K.K.) | 10 parts |
| surface active type lubricant | |
| phlorocarbon type surfactant: Defenser MCF323 (Dainippon Ink Kagaku K.K.) | 5 parts |
| solvent | |
| dichloromethane | 835 parts |

Example 3

Similarly to the foregoing examples 1 and 2, in order to obtain necessary high concentration for OHP application, the high concentration yellow, magenta, cyan and black inks of the following contents were prepared. These high concentration inks are coated on one side of a polycarbonate film of 3.0 μm thickness, in overall width of the film, and in the length of 8 cm, and in order of yellow, magenta, cyan and black. Thus, the color thermal printing sheet was obtained. Here, as the coater, the helio type gravure printing press with plate cylinder of 175 mesh was used.

| | |
|---|---|
| Yellow Ink | |
| dyes | |
| C.I. solvent yellow 163 (anthraquinone type) | 20 parts |
| C.I. disperse yellow 49 (quinophthalone type) | 10 parts |
| C.I. disperse yellow 54 (quinophthalone type) | 10 parts |
| C.I. disperse yellow 64 (quinophthalone type) | 10 parts |
| C.I. disperse yellow 224 (quinophthalone type) | 10 parts |
| C.I. disperse yellow 231 (pyridone type) | 10 parts |
| C.I. disperse yellow 42 (nitro type) | 10 parts |
| C.I. disperse yellow 122 (acrido type) | 10 parts |
| binder | |
| polyvinyl acetal: resin BY-111 (Denki Kagaku Kogyo K.K.) | 30 parts |
| bridging agent | |
| polyisocyanate: resin Takenate D110N (Takeda Yakuhin Kogyo K.K.) | 10 parts |
| surface active type lubricant | |
| phlorocarbon type surfactant: Defenser MCF323 (Dainippon Ink Kagaku K.K.) | 5 parts |

-continued

| | |
|---|---|
| solvent | |
| toluene/dichloromethane/MEK (2:1:1) | 865 parts |
| Magenta Ink | |
| dyes | |
| C.I. disperse red 11 | 10 parts |
| C.I. disperse red 53 | 10 parts |
| C.I. disperse red 60 | 10 parts |
| C.I. disperse red 91 | 10 parts |
| C.I. disperse red 127 | 10 parts |
| C.I. disperse red 168 | 10 parts |
| C.I. solvent red 52 | 10 parts |
| C.I. solvent red 155 | 10 parts |
| C.I. disperse violet 26 | 15 parts |
| C.I. disperse violet 31 | 15 parts |
| C.I. solvent violet 36 | 10 parts |
| binder | |
| polyvinyl acetal: resin 6000-C (Denki Kagaku Kogyo K.K.) | 30 parts |
| bridging agent | |
| polyisocyanate: resin Takenate D110N (Takeda Yakuhin Kogyo K.K.) | 10 parts |
| surface active type lubricant | |
| phlorocarbon type surfactant: Defenser MCF323 (Dainippon Ink Kagaku K.K.) | 5 parts |
| solvent | |
| dichloromethane/chloroform (8:2) | 845 parts |
| Cyan Ink | |
| dyes | |
| C.I. disperse blue 7 | 10 parts |
| C.I. disperse blue 56 | 10 parts |
| C.I. disperse blue 60 | 15 parts |
| C.I. disperse blue 87 | 15 parts |
| C.I. disperse blue 149 | 10 parts |
| C.I. disperse blue 165 | 10 parts |
| C.I. disperse blue 185 | 10 parts |
| C.I. disperse blue 197 | 10 parts |
| C.I. disperse blue 198 | 10 parts |
| C.I. solvent blue 105 | 15 parts |
| C.I. solvent green 3 | 15 parts |
| binder | |
| polyvinyl acetal: resin 6000-C (Denki Kagaku Kogyo K.K.) | 30 parts |
| bridging agent | |
| polyisocyanate: resin Takenate D110N (Takeda Yakuhin Kogyo K.K.) | 10 parts |
| surface active type lubricant | |
| phlorocarbon type surfactant: Defenser MCF323 (Dainippon Ink Kagaku K.K.) | 5 parts |
| solvent | |
| dichloromethane/chloroform (8:2) | 825 parts |
| Black Ink | |
| dyes | |
| C.I. solvent yellow 163 (anthraquinone type) | 20 parts |
| C.I. disperse yellow 231 (pyridone type) | 20 parts |
| C.I. disperse red 60 | 20 parts |
| C.I. disperse red 168 | 20 parts |
| C.I. disperse violet 26 | 20 parts |
| C.I. solvent blue 63 | 25 parts |
| C.I. solvent blue 35 | 25 parts |
| C.I. solvent blue 36 | 25 parts |
| binder | |
| polyvinyl acetal: resin 6000-C (Denki Kagaku Kogyo K.K.) | 30 parts |
| bridging agent | |
| polyisocyanate: resin Takenate D110N (Takeda Yakuhin Kogyo K.K.) | 10 parts |
| surface active type lubricant | |
| phlorocarbon type surfactant: Defenser MCF323 (Dainippon Ink Kagaku K.K.) | 5 parts |
| solvent | |
| dichloromethane | 780 parts |

For demonstration of printing performance of the color thermal printing sheets of the above-mentioned examples, a polypropylene type synthetic paper of 150 μm thickness was used as printing medium. For this synthetic paper, a printing receptacle layer coating solution of the following composition was coated in an amount of 10 g/m$^2$ to form a printing receptacle layer.

| | |
|---|---|
| polyester resin UE-3210 (Yunichika K.K.) | 12.0 g |
| bridging agent: polyisocyanate resin Takenate D110N (Takeda Yakuhin Kogyo K.K.) | 0.6 g |
| silicon type surfactant KF-351 (Shin-etsu Kagaku K.K.) | 0.5 g |
| silicon type white resin fine powder X-52-590 (Shin-etsu Kagaku K.K.) | 0.5 g |
| Ultraviolet ray absorbent Sandovor EPU (Sando K.K.) | 0.4 g |
| toluene | 50 ml |
| methyl ethyl ketone | 50 ml |

The color thermal printing sheets obtained in the examples 1, 2 and 3 were set in overlapping fashion with the above-mentioned synthetic paper in a video printer (Hitachi Ltd. VY-50 type). Then, the still color image displayed on the video display was transferred on the synthetic paper by thermal printing. Through this, natural color prints with high fidelity and high resolution were obtained.

Each color layer on the color thermal printing sheet of the examples 1, 2 and 3 and the thermal printing image both exhibited light-proofing durability certainly classified in 7 to 8th grade in tests of JIS L 0841 (durability against sun beam), JIS L 0842 (durability against carbon arc light) and JIS L 0843 (durability against xenon arc light).

In addition, the color thermal printing sheets obtained in the examples did not cause blocking even when they are left in the rolled condition under thermostatic condition at 60° C. for 96 hours. Also, degradation of the printed image thereafter was not observed.

In addition, the Ames test known as a regular test from the viewpoint of environmental safety was performed. As a result, it was proven that the thermal printing sheet will not serve as mutagenic substance.

Although the invention has been illustrated and described with respect to exemplary embodiments thereof, it should be understood by those skilled in the art that the foregoing and various other changes, omissions and additions may be made therein and thereto, without departing from the spirit and scope of the present invention. Therefore, the present invention should not be understood as limited to the specific embodiments set out above but to include all possible embodiments within the scope encompassed by the appended claims and equivalents thereof.

What is claimed is:

1. A sublimation color thermal printing sheet including a material sheet on which a plurality of color ink layers at least including cyan, magenta and yellow formed from solutions of sublimation dyes in solvents are coated in a given order, wherein both of said cyan and magenta inks are formed by a mixture of a plurality of dyes at least including a plurality of anthraquinone chromophore dyes as base dye respectively, and said yellow ink is formed by a mixture of a plurality of dyes with at least adding a plurality of anthraquinone chromophore dyes to quinophthalone chromophore dye as base dye;

wherein a plurality of solutions of said plurality of anthraquinone chromophore dyes are formed such that each of the anthraquinone chromophore dyes is solved in a soluble amount with respect to each solvent respectively, said plurality of solutions of the anthraquinone chromophore dyes are mixed with each other so that the total amount of said anthraquinone chromophore dyes included in said solutions obtains an OD value equal to or more than 2.0 and high light-proofing durability equal to or higher than that of a silver salt photograph, and said cyan, magenta and yellow inks are formed by mixing the mixture of solutions of the anthraquinone chromophore dyes and other solutions of residual dyes.

2. A sublimation color thermal printing sheet as claimed in claim 1, wherein said yellow ink is formed by further adding at least one dye selected from the group consisting of acrido chromophore dye, nitro chromophore dye, pyridone chromophore dye and pyrazolone chromophore dye.

3. A sublimation color thermal printing sheet as claimed in claim 1, wherein said plurality of color ink layers further includes a black layer formed by mixing said cyan, magenta and yellow inks.

4. A sublimation color thermal printing sheet as claimed in claim 3, wherein said yellow ink includes orange color dyes, said magenta ink includes violet color dyes, said cyan ink includes green color dyes, and said black ink is formed by a mixture of said yellow, magenta and cyan inks.

5. A sublimation color thermal printing sheet as claimed in claim 1, wherein said solvent is one solvent material.

6. A sublimation color thermal printing sheet as claimed in claim 1, wherein said solvent is a mixture of at least two solvent materials, that correspond to said each dye respectively.

7. A sublimation color thermal printing sheet as claimed in claim 1, wherein each of said inks to be used for forming each of said color ink layers is prepared by solving said dyes with a solvent together with a binder in a content of 3–5 or more wt parts of said dyes, 1–20 wt parts of said binder, and 96–70 wt parts of said solvent in relation to 100 wt parts of total ink amount.

8. A sublimation color thermal printing sheet as claimed in claim 7, wherein said solvent is selected from the group consisting of chlorinated hydrocarbons, aromatic hydrocarbons and ketones.

9. A sublimation color thermal printing sheet as claimed in claim 8, wherein said solvent is selected from the group consisting of methylene dichloride, chloroform, chlorobenzene, toluene, xylene, methyl ethyl ketone and cyclohexanone.

10. A sublimation color thermal printing sheet as claimed in claim 7, wherein said binder is selected from the group consisting of polyvinyl acetal resin, saturated polyester resin, a mixture of saturated polyester resin and polycarbonate resin, and polysulfone resin.

11. A sublimation color thermal printing sheet as claimed in claim 1, wherein said material sheet is made of a plastic film which is selected from the group consisting of polyester, polyamide, polysulfone, polystyrene, vinyl chloride and polycarbonate, and a surface-finish is provided on the surface thereof mating with a thermal head, which surface-finish is selected from the group consisting of silicon resin, fluorine resin, fluorine lubricant and surfactant.

* * * * *